United States Patent [19]

Hargrave

[11] Patent Number: 4,903,968

[45] Date of Patent: Feb. 27, 1990

[54] GOLF SWING TRAINING APPARATUS

[76] Inventor: James R. Hargrave, P.O. Box 25, Loveland, Colo. 80539

[21] Appl. No.: 350,455

[22] Filed: May 11, 1989

[51] Int. Cl.[4] ..... A63B 69/36

[52] U.S. Cl. ..... 273/186 A; 273/193 R

[58] Field of Search ..... 273/186 R, 186 A, 186 B, 273/186 C, 186 D, 186 E, 193 R, 193 A, 193 B, 194 R, 191, 191 A, 183 D

[56] References Cited

U.S. PATENT DOCUMENTS

| | | | |
|---|---|---|---|
| 3,776,555 | 12/1973 | Hagaman | 273/186 R |
| 4,341,384 | 7/1982 | Thackrey | 273/186 A |
| 4,456,257 | 6/1984 | Perkins | 273/186 R |

*Primary Examiner*—George J. Marlo

*Attorney, Agent, or Firm*—William E. Hein

[57] ABSTRACT

A golfer swings an elongated implement which emits light from each end thereof. An upstanding frame provides a support for sensor/alarm units which are responsive to the light emitted from each end of the implement. The golf swing training apparatus serves to train a golfer's muscles to repeatedly perform the precise motion that has been proven over the years to be the technically correct swing motion required to excel at the sport of golf. The present invention permits the user to practice the golf swing motion slowly, stopping and holding the motion at each of several discrete, sequential positions of club alignment, thus imparting memory of the complete swing motion to the muscles involved in performing the swing motion.

6 Claims, 3 Drawing Sheets

FIG. 5G
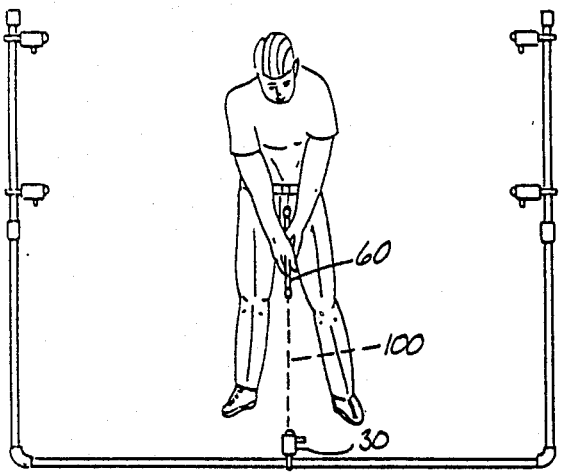
FIG. 5H
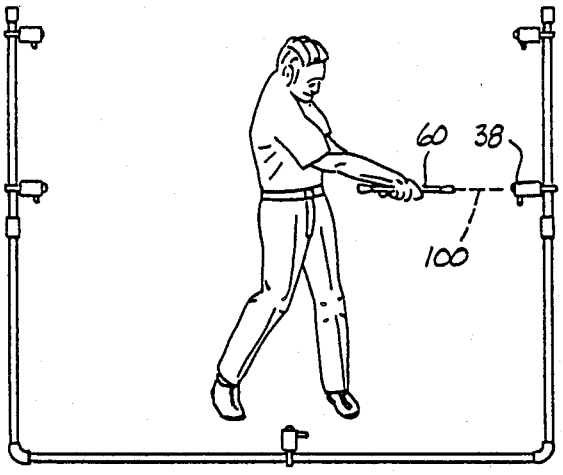
FIG. 5I
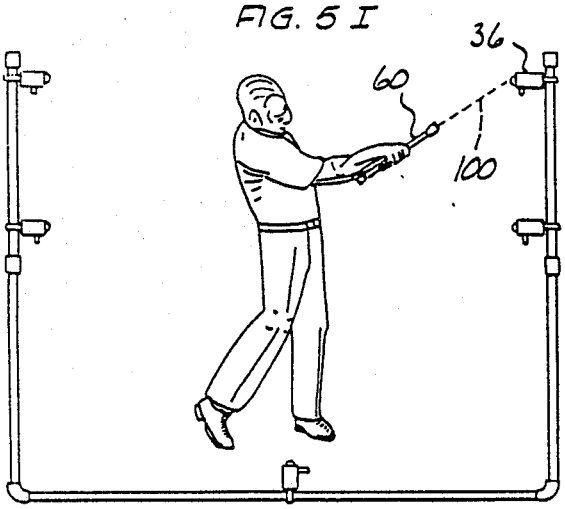
FIG. 5J
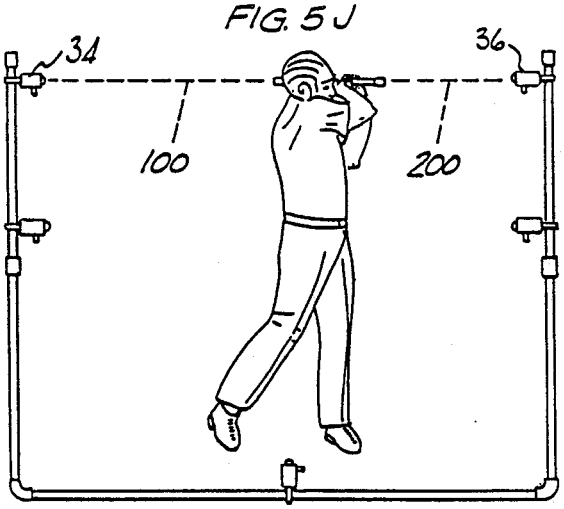
FIG. 5K
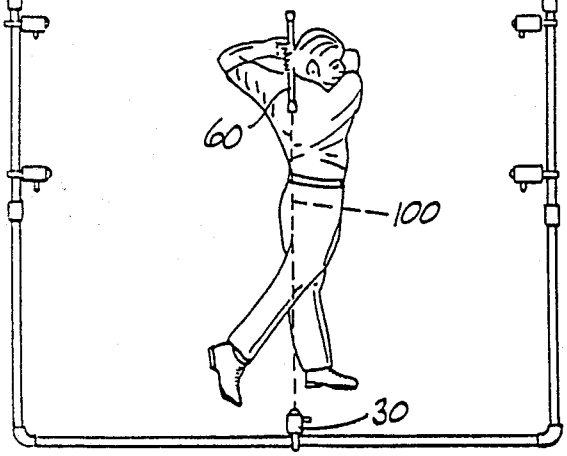
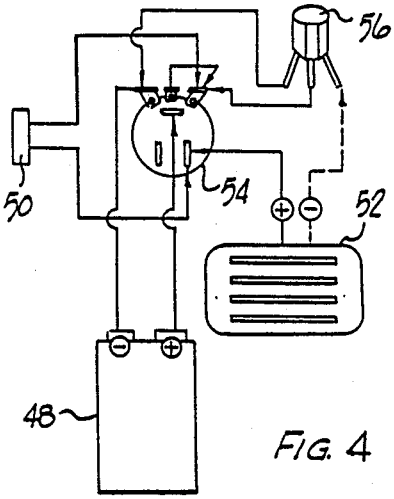
FIG. 4

GOLF SWING TRAINING APPARATUS

SUMMARY OF THE INVENTION

This invention relates generally to the sport of golf and more specifically to a training apparatus to enable the golfer to practice the correct golf club swing motion in his home, for example. It has been established over the years that a very precisely defined swing motion is required of golfers who wish to repeatedly hit the ball in such a way that superior results are consistently obtained. This technically correct swing motion is best learned by passively training the muscles to "memorize" each critical position comprising a complete swing motion. No training apparatus is known by which the serious golfer can passively train the muscles involved in executing the complete swing motion and thereby perfect his swing and achieve excellence at the sport. The serious golfer's normal option presently is to practice his swing in the presence of an instructor who is able to offer critical comments regarding the observed swing motion. This method of training is expensive and generally inadequate because it does not usually offer sufficiently intensive training. The proper golf swing motion requires that the club travel in a full 360-degree arc from the beginning of the swing to the completion of the swing. In addition, proper swing technique requires that the club travel in a swing plane that forms a 60-degree angle with the horizontal. Finally, proper swing technique requires that the club travel through several well-defined, discrete, sequential positions of alignment during the swing motion.

It is therefore the principal object of the present invention to provide an inexpensive, yet very effective, golf swing training apparatus that serves to train a golfer's muscles to repeatedly perform the precise motion that has been proven over the years to be the technically correct swing motion required to excel at the sport of golf. Very importantly, the training apparatus of the present invention allows the user to practice the technically correct complete golf swing motion slowly, stopping and holding the motion at each of the several discrete, sequential positions of club alignment, thus imparting memory of the complete swing motion to the muscles involved in performing the swing motion. As a result, those muscles are able to recall the "memorized" correct swing motion when the golfer later executes his swing at full speed on the golf course. This training theory involving muscle memory and recall is well recognized and supported in the field of sports medicine.

This and other incidental objects are accomplished in accordance with the illustrated preferred embodiment of the present invention by providing a golf swing training apparatus comprising a frame positioned at a 60-degree angle to the horizontal. Five light sensor/alarm units are strategically positioned in a common plane on the frame member. The light sensor/alarm units are adjustable on the frame so that the golf swing training apparatus can be used by all golfers, regardless of height. A handle unit simulating the portion of a golf club gripped by the user includes light sources at each end thereof emitting focused beams of light. The handle unit is gripped by the user as he or she would grip a golf club and is moved in sequence through each of the critical positions of club alignment comprising a complete golf swing motion. The user stops and holds the swing motion for a few seconds at each of these critical positions, allowing one or both of the focused light beams to be sensed by an associated one or pair of the light sensor/alarm units, thereby sounding a buzzer to indicate to the user that he or she has reached a particular one of the critical positions comprising a golf swing motion.

BRIEF DESCRIPTION OF THE DRAWINGS

FIG. 4 is a detailed schematic diagram of the circuitry employed in the light sensor/alarm units of FIGS. 1 and 2.

FIGS. 5A–K are sequential pictorial illustrations of the golf swing training apparatus of FIG. 1 and the light beam emitting handle unit of FIG. 3 in use, showing the eleven discrete, sequential critical positions of club alignment comprising a complete golf swing motion.

DESCRIPTION OF THE PREFERRED EMBODIMENT

Figure 1:
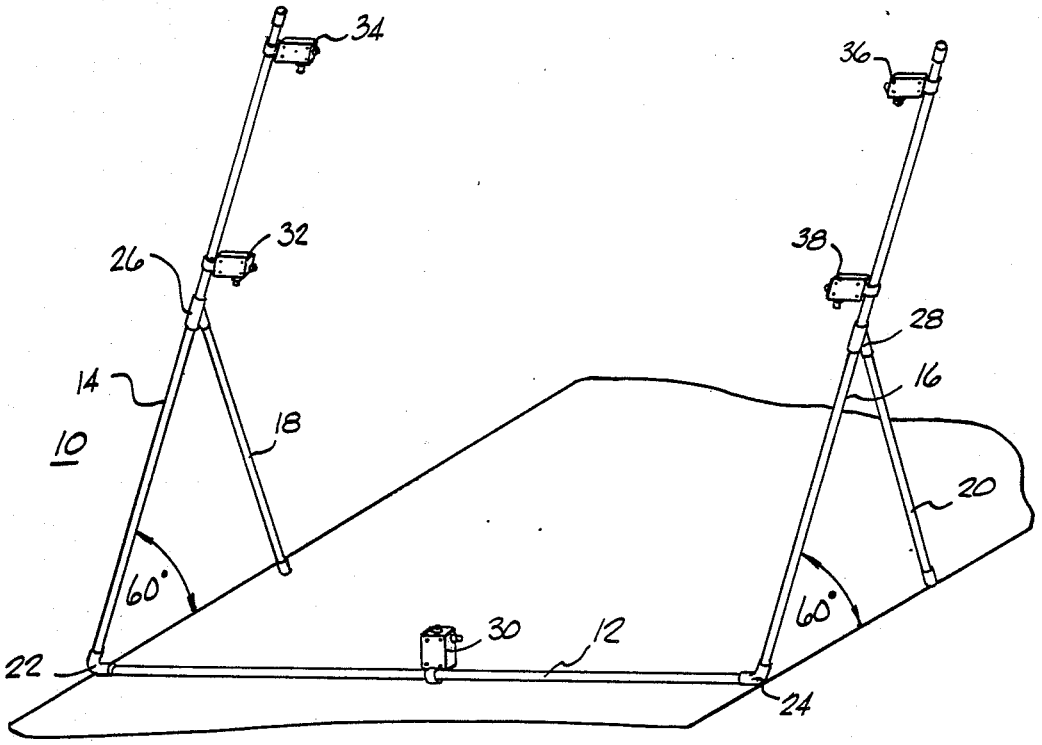
FIG. 1 is a pictorial illustration of the frame member and light sensor/alarm units of the golf swing training apparatus of the present invention.

Referring now to FIG. 1, there is shown a golf swing training apparatus frame 10 that comprises a horizontal member 12, two upright members 14 and 16, and floor support members 18 and 20. Frame 10 is fabricated using conventional aluminum or PVC tubing of a convenient diameter, such as ½ inch. Horizontal member 12 is attached to upright members 14 and 16 by way of a pair of right angle connectors 22 and 24. Upright members 14 and 16 are supported at a 60-degree angle to the horizontal by support members 18 and 20. Support members 18 and 20 are coupled to upright members 14 and 16 by 60-degree connectors 26 and 28. Additionally, upright members 14 and 16 preferably each comprise approximately equal lengths of tubing material coupled together by 60-degree connectors 26 and 28.

Figure 2:
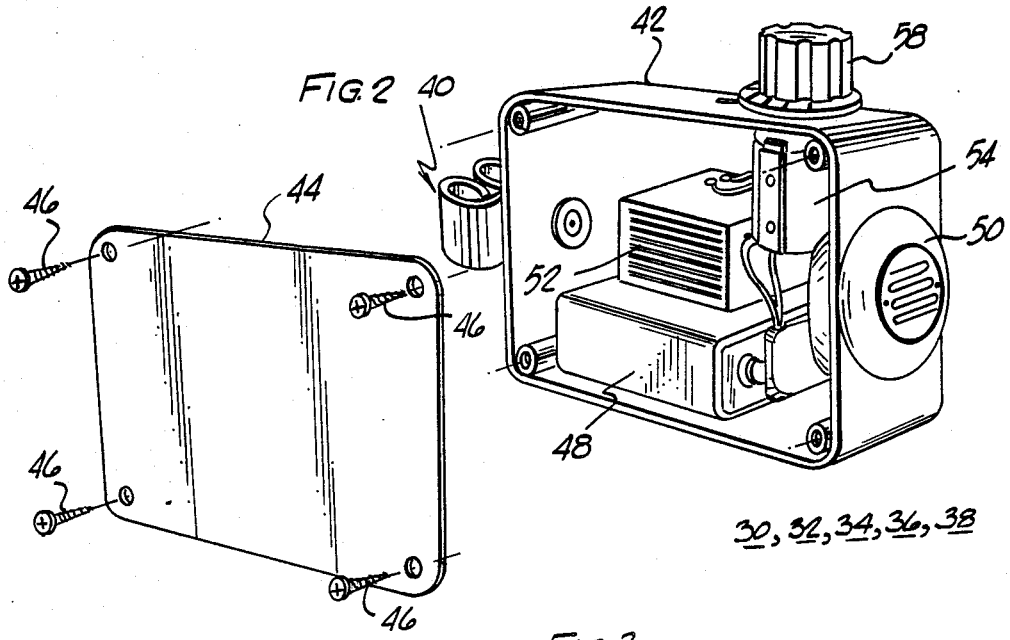
FIG. 2 is a detailed illustration of one of the light sensor/alarm units employed in the golf swing training apparatus of FIG. 1.

Five light sensor/alarm units 30, 32, 34, 36, and 38, the mechanical and electrical details of which are illustrated in FIGS. 2 and 4, respectively, are removably attached to frame 10 by means of conventional spring clamps 40. Each of the light sensor/alarm units 30, 32, 34, 36, and 38 comprises a housing 42 and a housing cover 44 attached thereto by screws 46. Within housing 42, each of the light sensor/alarm unit comprises a 9-volt battery 48, a ½-inch diameter photocell 50, a 6-volt DC buzzer 52, a combination 1OK ohm miniature audio taper volume control and SPDT switch 54, and a 2N4401 NPN transistor 56, mechanically arranged as illustrated in FIG. 2 and electrically connected as shown in FIG. 4. All of these electrical components are readily available from Radio Shack stores, for example, as off-the-shelf items. Light sensor/alarm unit 30 is clamped onto horizontal member 12 near the center of the length thereof and at a 60-degree angle to the horizontal. Light sensor/alarm units 32 and 34 are clamped to upright members 14 and 16, respectively, so as to be facing inwardly toward each other at the height of the user's navel. Similary, light sensor/alarm units 36 and 38 are clamped to upright members 14 and 16, respectively, so as to be facing inwardly toward each other at a height approximately two inches above the user's shoulder line. Thus, each of light sensor/alarm units 30, 32, 34, 36, and 38 lies in the plane defined by horizontal member 12 and upright members 14 and 16, which plane is tilted backward at an angle of 60 degrees to the horizontal. Prior to use of the golf swing training apparatus, light sensor/alarm units 30, 32, 34, 36, and 38 must be individually adjusted to set a threshold sensing level that accounts for ambient light conditions. Best results are obtained when using the golf swing training apparatus in conditions of artificial light rather than in bright sunlight. A control knob 58, shown in FIG. 2, connected to control and switch 54 is employed to set the threshold sensing level. Control knob 58 is first operated to turn on the light sensor/alarm unit being set, is then advanced until buzzer 52 of that light sensor/alarm unit is activated, and is then backed off slightly until the buzzing stops. This process is repeated to set the remaining four light sensor/alarm units. At this point, only a focused light beam directed to a particular one of the light sensor/alarm units from a light beam emitting handle unit 60, described below, will cause that light sensor/alarm unit to begin buzzing. When the focused light beam is directed away from an activated light sensor/alarm unit, the buzzing of that unit stops.

Figure 3:
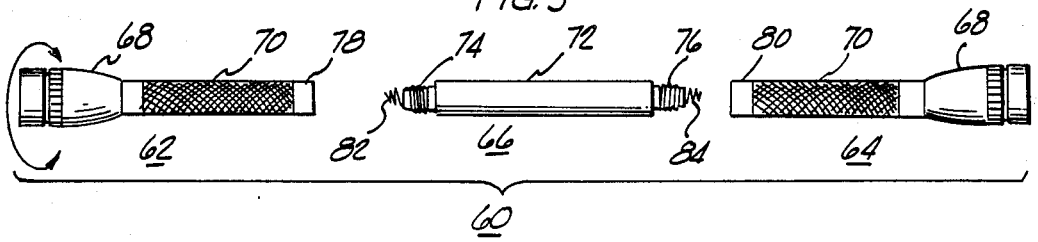
FIG. 3 is a detailed illustration of a light beam emitting handle unit employed with the golf swing training apparatus of FIG. 1.

Referring now to FIG. 3, there is shown a light beam emitting handle unit 60 that comprises a pair of focusable light sources 62 and 64 that are connected in an aligned back-to-back relationship to each other. Light sources 62 and 64 may comprise, for example, off-the-shelf flashlights such as the Black Max model manufactured by L. D. Brinkman Company, Kansas City, Mo. Focusing rings 68 serve to turn the flashlights on and off and for focusing the light beams emitted therefrom. Each of light sources 62 and 64 includes a barrel section 70 that holds two standard AA batteries. A connecting section 72, that may be fabricated of aluminum bar stock, includes threaded ends 74 and 76 adapted to mate with inside threads at threaded ends 78 and 80 of light sources 62 and 64. A pair of springs 82 and 84, inset into threaded ends 74 and 76 of connecting section 72, serve to hold the batteries in place in barrel sections 70 of light sources 62 and 64.

Figure 5A:
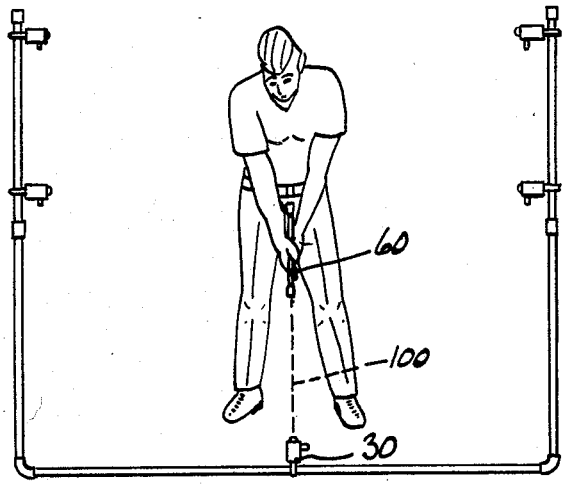

Referring now to FIGS. 5A–K, there are shown eleven sequential pictorial illustrations of the golf swing training apparatus frame 10 and the light beam emitting handle unit 60 in use. These eleven sequential pictorial illustrations each show one of the eleven discrete, sequential critical positions of club alignment comprising a complete golf swing motion. In FIG. 5A, the user is shown in an address or start position gripping light beam emitting handle unit 60 as he would a golf club. The user positions himself approximately 18–24 inches behind light sensor/alarm unit 30 so that handle unit 60 is aligned at the critical 60-degree angle to the horizontal so as to lie in the same plane as light sensor/alarm units 30, 32, 34, 36, and 38. In this address position, a light beam 100 emitted from one end of handle unit 60 is focused on light sensor/alarm unit 30, thereby activating it. In this position the user's arms should hang so as to form a vee shape, and there should be no tension in the forearms.

Figure 5B:
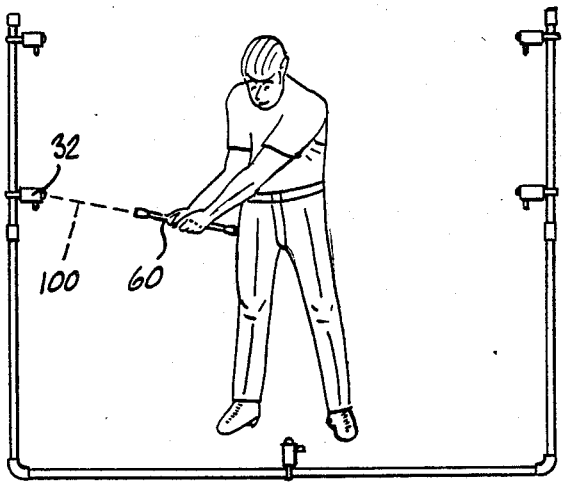
Figure 5C:
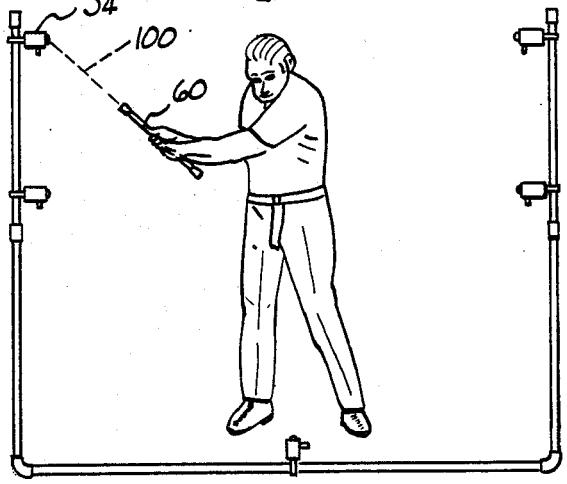
Figure 5D:
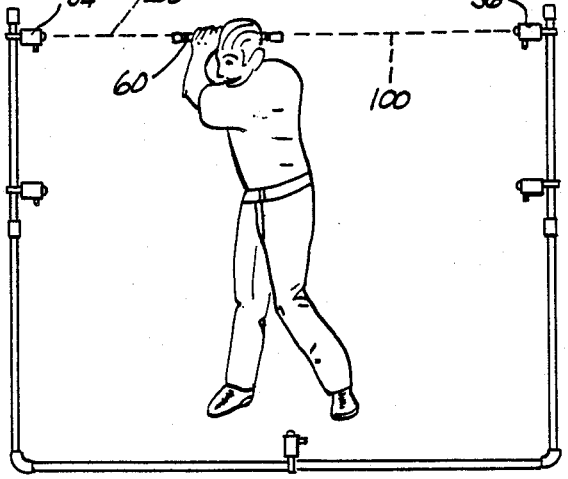
Figure 5E:
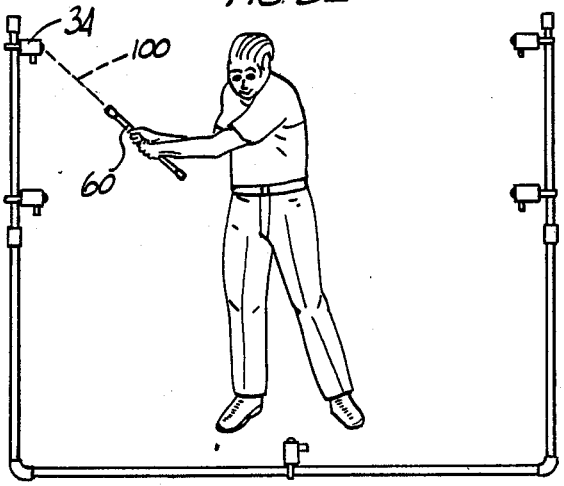
Figure 5F:
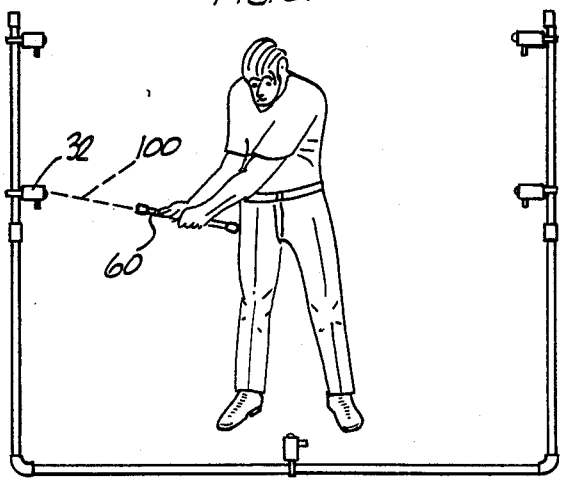

In FIG. 5B, the user employs the one-piece takeaway technique to turn his left shoulder under his chin and move the handle unit 60 so that light beam 100 is focused on light sensor/alarm unit 32 to activate it. This position of handle unit 60 is held for 5–10 seconds, at which time the user moves the handle unit 60 into the position shown in FIG. 5C so that light beam 100 activates light sensor/alarm unit 34. This position is associated with the beginning of the wrist cock. After holding this position for 5–10 seconds, the user moves the handle unit 60 to the top of the swing motion, as illustrated in FIG. 5D. In this position, light beam 100 activates light sensor/alarm unit 36, and a second light beam 200 emitted from the opposite end of handle unit 60 serves to simultaneously activate light sensor/alarm unit 34. After holding this position for 5–10 seconds, the user shifts his weight from right foot to his left foot to start the down swing, stopping and holding the position illustrated in FIG. 5E to activate light sensor/alarm unit 34. The down swing is continued to the position shown in FIG. 5F, in which the light beam 100 activates light sensor/alarm unit 32. After holding this position for 5–10 seconds, the user moves handle unit 60 into the hitting zone, as illustrated in FIG. 5G. In this position, also held for 5–10 seconds, light beam 100 activates light sensor/alarm unit 30. The user then moves handle unit 60 to the position known as the beginning of the follow through by turning his right shoulder under his chin, as illustrated in FIG. 5H. In this position, likewise held for 5–10 seconds, light beam 100 activates light sensor/alarm unit 38. Continuing the follow through, the user moves the handle unit 60 to the position illustrated in FIG. 51, in which light beam 100 activates light sensor/alarm unit 36. After holding this position for a few seconds, the user moves handle unit 60 to the top of the position known as the top of the follow through, as illustrated in FIG. 5J. In this position, light beam 100 activates light sensor/alarm unit 34, and light beam 200 simultaneously activates light sensor/alarm unit 36. Finally, after also holding this position for a few seconds, the user moves to the position illustrated in FIG. 5K, known as the finish of the follow through. In this final one of the eleven critical positions illustrated, light beam 100 activates light sensor/alarm unit 30 during the few seconds that the position is held.

I claim:

1. A golf swing training apparatus comprising:

frame means positioned on a substantially horizontal surface;

a plurality of light sensor/alarm units positioned in a common plane on said frame means, each of said plurality of light sensor/alarm units being responsive, during such period of time that a light beam is incident thereon, for emitting an audio signal; and handle means generally elongate in shape, said handle means adapted to be gripped by the user in like manner to a golf club, said handle means further comprising light beam source means for emitting a focused light beam from each end thereof, each of the focused light beams being generally axially aligned with said handle means.

2. A golf swing training apparatus as in claim 1 wherein said common plane forms approximately a 60-degree angle with the horizontal.

3. A golf swing training apparatus as in claim 2 wherein said frame means comprises:

a pair of spaced apart vertical frame members extending upwardly at approximately a 60-degree angle to the horizontal;

a horizontal frame member connecting said pair of spaced apart vertical frame members; and a pair of support members, each supporting one of said pair of spaced apart vertical frame members at said approximate 60-degree angle to the horizontal.

4. A golf swing training apparatus as in claim 3 wherein:

one of said plurality of light sensor/alarm units is positioned centrally on said horizontal frame member;

two of said plurality of light sensor/alarm units are positioned inwardly facing and opposite each other on said pair of spaced apart vertical frame members at a height approximating that of the user's waist; and two of said plurality of light sensor/alarm units are positioned inwardly facing and opposite each other on said pair of spaced apart vertical frame members at a height approximating that of the user's shoulders.

5. A golf swing training apparatus as in claim 4 wherein each of said plurality of light sensor/alarm units includes control means for applying operating power thereto and for setting a threshold light sensitivity level.

6. A process for training the muscles of a user to repeatedly perform a precise golf swing motion, the process comprising:

providing a golf swing training apparatus including frame means adapted to be positioned on a substantially horizontal surface; a plurality of light sensor/alarm units all positioned in a common swing plane on said frame means, said swing plane forming approximately a 60-degree angle with the horizontal, each of said plurality of light sensor/alarm units being positioned in alignment with different critical positions of club alignment representing a complete golf swing motion, each of said plurality of light sensor/alarm units being responsive, during such period of time that a light beam is incident thereon, for emitting an audio signal; and handle means generally elongate in shape, said handle means being adapted to be gripped by the user in like manner to a golf club, said handle means further comprising light beam source means for emitting a focused light beam from each end thereof;

establishing a training position of the user with respect to said golf swing training apparatus, said training position simulating the stance of a golfer preparatory to swinging a golf club, said training position being such that said handle means is positioned in said swing plane when gripped by the user; and sequentially moving said handle means, in said swing plane, to each one of a plurality of critical positions of club alignment representing a complete golf swing motion, the motion of said handle means being momentarily stopped and held at each one of said plurality of critical positions to permit an associated one or more of said plurality of light sensor/alarm units to respond to one or both of the light beams emitted by said handle means and to emit said audio signal during the period of time in which said motion is stopped and held.

* * * * *